US006163904A

United States Patent [19]

Royston

[11] Patent Number: 6,163,904

[45] Date of Patent: Dec. 26, 2000

[54] ARTICULATED TABLE FOR SUPPORTING A PERSON

[75] Inventor: John H. Royston, Santa Rosa, Calif.

[73] Assignee: Everett Associates, Inc., Santa Rosa, Calif.

[21] Appl. No.: 09/207,290

[22] Filed: Dec. 8, 1998

[51] Int. Cl.[7] ..... A61G 7/05

[52] U.S. Cl. ..... 5/618; 5/600; 5/613; 5/616

[58] Field of Search ..... 5/600, 613, 616, 5/617, 618, 620

[56] References Cited

U.S. PATENT DOCUMENTS

| | | | |
|---|---|---|---|
| 2,917,753 | 12/1959 | Portis et al. | 5/618 |
| 3,278,952 | 10/1966 | Holm | 5/616 |
| 5,063,623 | 11/1991 | Bathrick et al. . | |
| 5,157,787 | 10/1992 | Donnellan et al. . | |
| 5,161,274 | 11/1992 | Hayes et al. | 5/616 X |
| 5,500,002 | 3/1996 | Riddle et al. . | |
| 5,579,550 | 12/1996 | Bathrick et al. . | |

*Primary Examiner*—Terry Lee Melius
*Assistant Examiner*—Fredrick Conley
*Attorney, Agent, or Firm*—Jack Lo

[57] ABSTRACT

An articulated table for supporting a person is comprised of a frame with legs, an articulated tabletop supported by the frame, and a motorized actuator assembly under the tabletop. The tabletop includes a pivotable torso section hinged to a fixed seat section, which is hinged to a pivotable upper leg section, which is hinged to a pivotable lower leg section. The actuator assembly includes first and second pairs of actuating linkages for respectively moving the torso and upper leg sections. Each actuating linkage is comprised of a power axle spaced from a follower axle. A crank arm extends orthogonally from the power axle. A lifting arm extends orthogonally but unevenly in different directions from the follower axle. Rotation of the crank arm is transmitted to the lifting arm by a connecting arm pivotally connected between the crank arm and a shorter section of the lifting arm. A roller is attached to the end of the longer section of the lifting arm. To raise the tabletop, the longer section of the lifting arm of each actuating linkage is rotated upwardly in a predetermined direction by rotating the crank arm in a similar direction. The lower leg section is kept in a level attitude throughout its range of movement by idler arms connected between its lower side and the frame.

9 Claims, 4 Drawing Sheets

ARTICULATED TABLE FOR SUPPORTING A PERSON

BACKGROUND OF THE INVENTION

1. Field of the Invention

This invention relates generally to articulated or adjustable beds and massage tables.

2. Prior Art

Adjustable beds and massage tables are typically comprised of several articulated sections pivotable to different positions for raising a person's torso and legs. For example, U.S. Pat. Nos. 5,579,550 and 5,063,623 to Bathrick et al. shows an adjustable bed with torso and upper leg sections hinged to a fixed seat, and a lower leg section hinged to the upper leg section. The torso and upper leg sections are actuated by motorized lever arms which are each pivoted about a single fixed axis. U.S. Pat. No. 5,157,787 to Donnellan et al. shows an adjustable bed with a torso, upper leg, and lower leg sections which are all pivotable and directly actuated by hydraulic cylinders. In these devices, the angle of the lower leg section is varied throughout the range of movement. U.S. Pat. No. 5,500,002 to Riddle et al. shows a bed with torso and leg sections hinged to a fixed seat section. The head and leg sections are actuated by motorized crank arms. Because these adjustable beds are low to the ground, they cannot be used as massage tables. Further, many of them include bulky actuating mechanisms that eliminate the leg room needed by a massage therapists for sitting next to the table.

OBJECTS OF THE INVENTION

Accordingly, objects of the present articulated table are:

to provide articulated sections for raising a person's torso and legs to different positions;

to employ a compact actuator assembly for providing enough leg room for a massage therapist to sit next to the table; and to maintain a lower leg section in a comfortable level position throughout its range of adjustment.

Further objects of the present invention will become apparent from a consideration of the drawings and ensuing description.

BRIEF SUMMARY OF THE INVENTION

An articulated table for supporting a person is comprised of a frame with legs, an articulated tabletop supported by the frame, and a motorized actuator assembly under the tabletop. The tabletop includes a pivotable torso section hinged to a fixed seat section, which is hinged to a pivotable upper leg section, which is hinged to a pivotable lower leg section. The actuator assembly includes first and second pairs of actuating linkages for respectively moving the torso and upper leg sections. Each actuating linkage is comprised of a power axle spaced from a follower axle. A crank arm extends orthogonally from the power axle. A lifting arm extends orthogonally but unevenly in different directions from the follower axle. Rotation of the crank arm is transmitted to the lifting arm by a connecting arm pivotally connected between the crank arm and a shorter section of the lifting arm. A roller is attached to the end of the longer section of the lifting arm. To raise the tabletop, the longer section of the lifting arm of each actuating linkage is rotated upwardly in a predetermined direction by rotating the crank arm in a similar direction. The lower leg section is kept in a level attitude throughout its range of movement by idler arms connected between its lower side and the frame.

Figure 1:
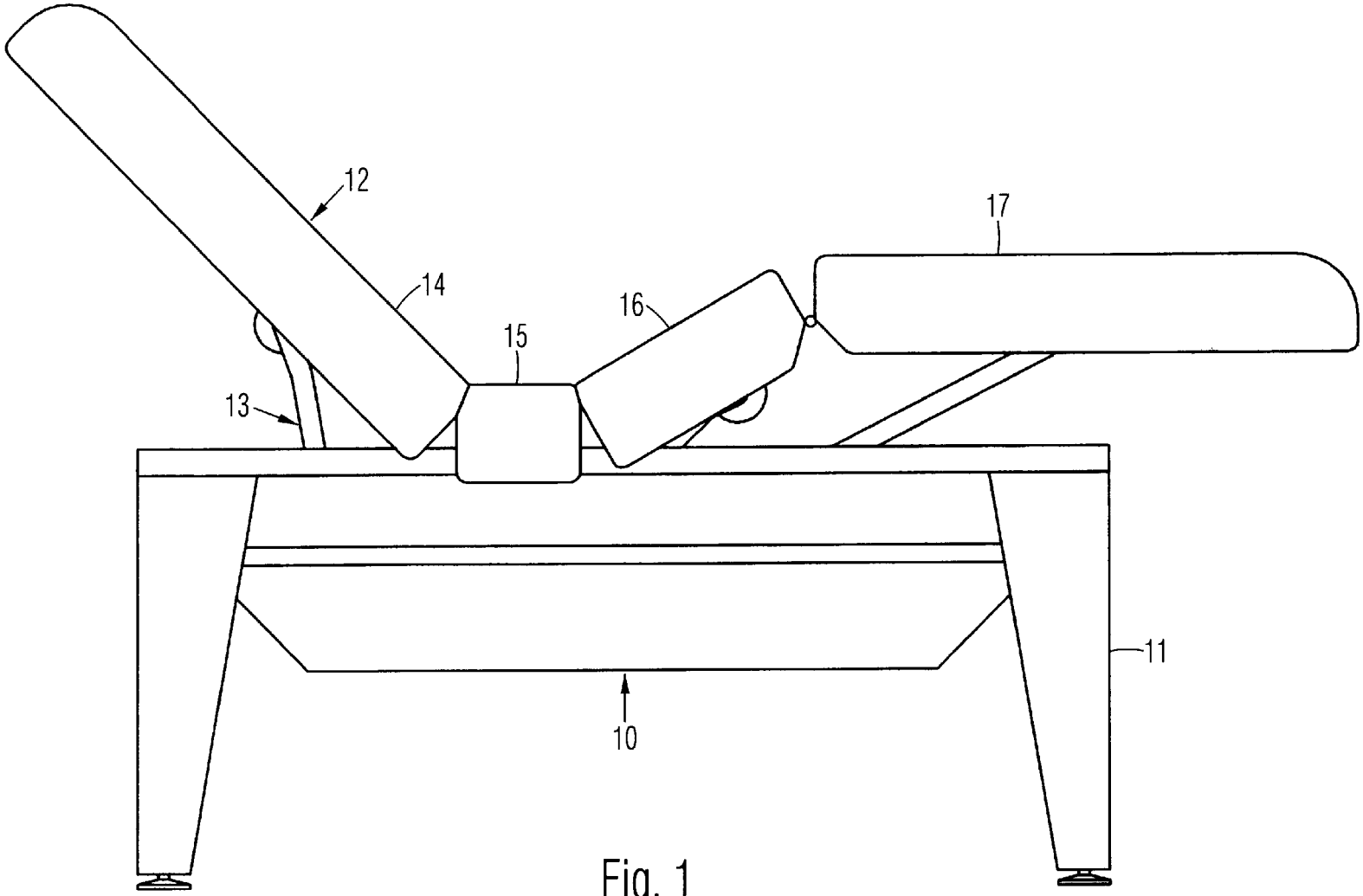
FIG. 1 is a side view of the present articulated table with a tabletop in a fully raised position.

| DRAWING REFERENCE NUMERALS |
|---|
| 10. Frame |
| 11. Legs |
| 12. Tabletop |
| 13. Actuator |
| 14. Torso Section |
| 15. Seat Section |
| 16. Upper Leg Section |
| 17. Lower Leg Section |
| 18. Drive Unit |
| 19. Actuating Linkages |
| 20. Torso End |
| 21. Actuating Linkages |
| 22. Leg End |
| 23. Powered Axle |
| 24. Follower Axle |
| 25. Crank Arm |
| 26. Lifting Arm |
| 27. Connecting Arm |
| 28. Floating Axle |
| 29. Floating Axle |
| 30. Roller |
| 31. Idler Arms |
| 32. Fixed Axles |

DETAILED DESCRIPTION OF THE INVENTION

FIG. 1:

A preferred embodiment of the articulated table for supporting a person is shown in a side view in FIG. 1. It is comprised of a frame 10 with legs 11, an articulated tabletop 12 supported by frame 10, and an actuator assembly 13 attached to frame 10 under tabletop 12. Tabletop 12 is comprised of a movable torso section 14 hinged to a fixed seat section 15, a movable upper leg section 16 hinged to fixed seat section 15, and a lower leg section 17 hinged to upper leg section 16. Tabletop 12 is shown in a fully raised position. Actuator assembly 13 is thin enough to provide adequate legroom for a massage therapist sitting next to the table.

Figure 2:
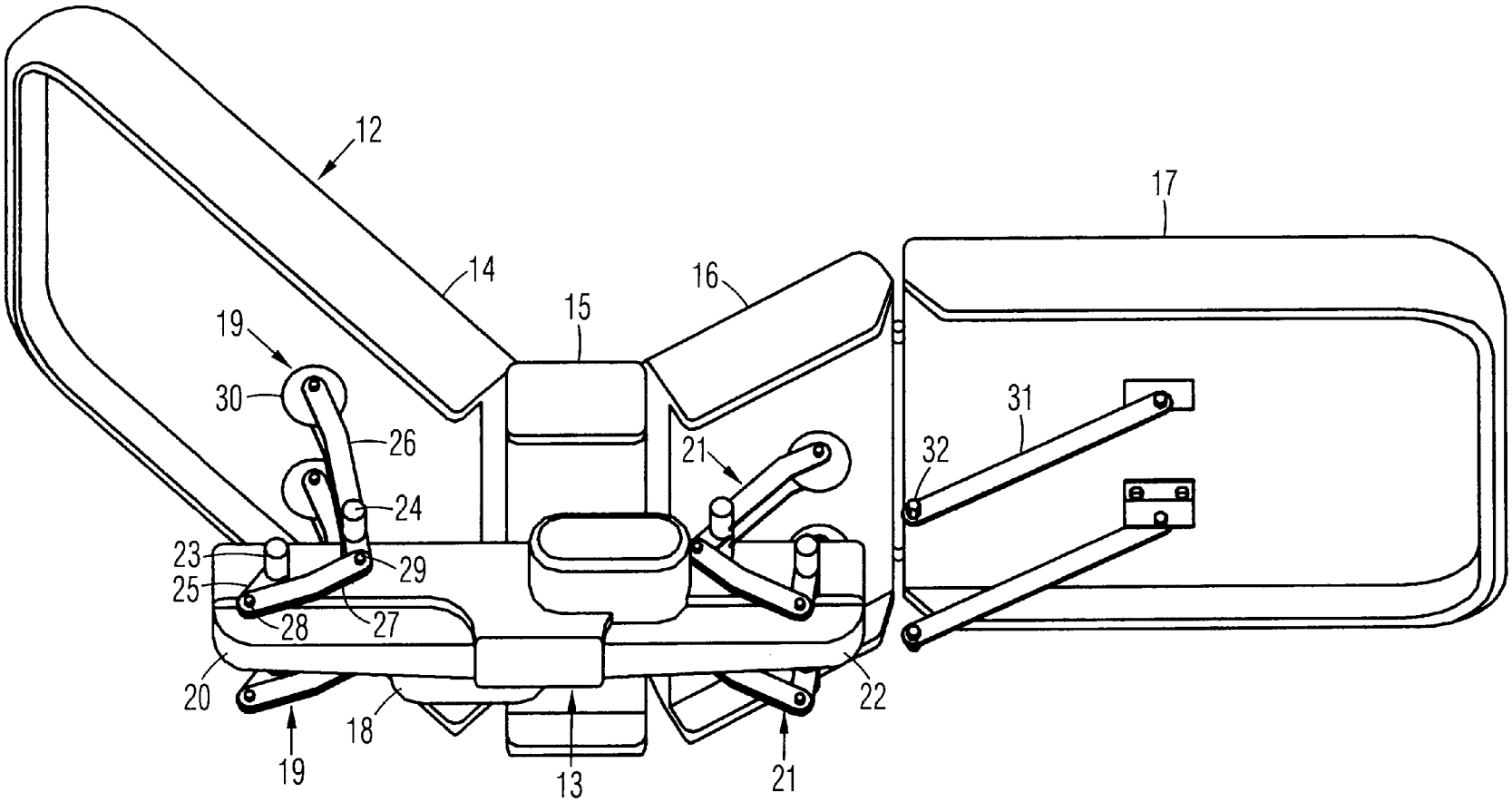
FIG. 2 is a bottom perspective broken view of the tabletop in the fully raised position.

FIGS. 2–3:

Tabletop 12 is shown in a bottom perspective view in FIG. 2 without frame 10 (FIG. 1) to clearly illustrate the construction and operation of actuator assembly 13, which includes a motorized drive unit 18, such as the "TRIOMAT" made by Dewert Motorized Systems in Frederick, Md. A first pair of actuating linkages 19 are attached to opposite sides of drive unit 18 at a torso end 20, and a second pair of actuating linkages 21 are attached to opposite sides of drive unit 18 at a leg end 22. The linkages in each pair are mirrored normal to a transverse axis of tabletop 12.

Each actuating linkage 19 is comprised of a powered axle 23 with an axis fixed in relation to drive unit 18 and the frame. Powered axle 23 is spaced from a follower axle 24 which also has an axis fixed in relation to drive unit 18 and the frame. Powered axle 23 and follower axle 24 are additions to the prefabricated drive unit 18. The rotation of powered axle 23 is controlled by conventional controls (not shown) connected to drive unit 18. Actuating linkage 19 also includes a crank arm 25 rigidly extending orthogonally from powered axle 23, a lifting arm 26 rigidly extending orthogonally in opposite directions from follower axle 24 forming a longer section and a shorter section. A connecting arm 27 has one end pivotally connected to an end of crank arm 25 by a first floating axle 28, and another end pivotally connected to the shorter section of lifting arm 26 by a second floating axle 29. A roller 30 is attached to the end of the longer section of lifting arm 26, and is in rolling engagement against the bottom side of torso section 14. Actuating linkages 21 generally mirror actuating linkages 19 normal to a longitudinal axis of tabletop 12, but with arms of slightly different lengths.

A pair of idler arms 31 each has one end pivotally connected to a bottom side of lower leg section 17, and another end pivotally connected to frame 10 (FIG. 1) about fixed axles 32. Upper leg section 16 and lower leg section 17 are hinged together for simultaneous movement. Idler arms 31 and upper leg section 16 are generally parallel and equal in length, so that they cooperate to maintain lower leg section 17 in a comfortable horizontal position throughout its range of travel.

In FIG. 2, tabletop 12 is shown in a fully raised position in which torso section 14, upper leg section 16, and lower leg section 17 are all lifted to their highest positions for supporting a person with the most bending in the hips and knees. For each actuating linkage 19, powered axle 23 is rotated to its most clockwise position, so that the longer section of lifting arm 26 is rotated to its highest position, and torso section 14 is lifted to its highest position. Actuating linkages 21 are also in their highest positions to support upper leg section 16 and lower leg section 17 in their highest positions.

Figure 3:
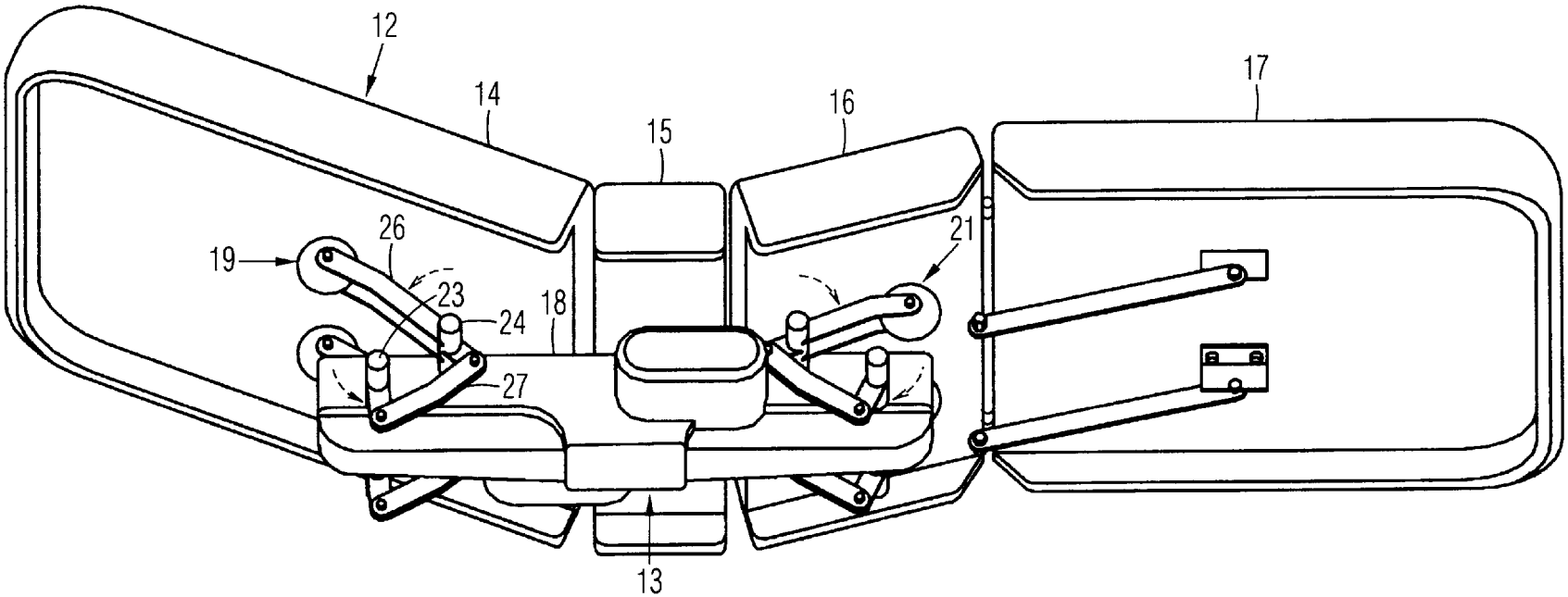
FIG. 3 is a bottom perspective broken view of the tabletop in an intermediate position.
Figure 4:
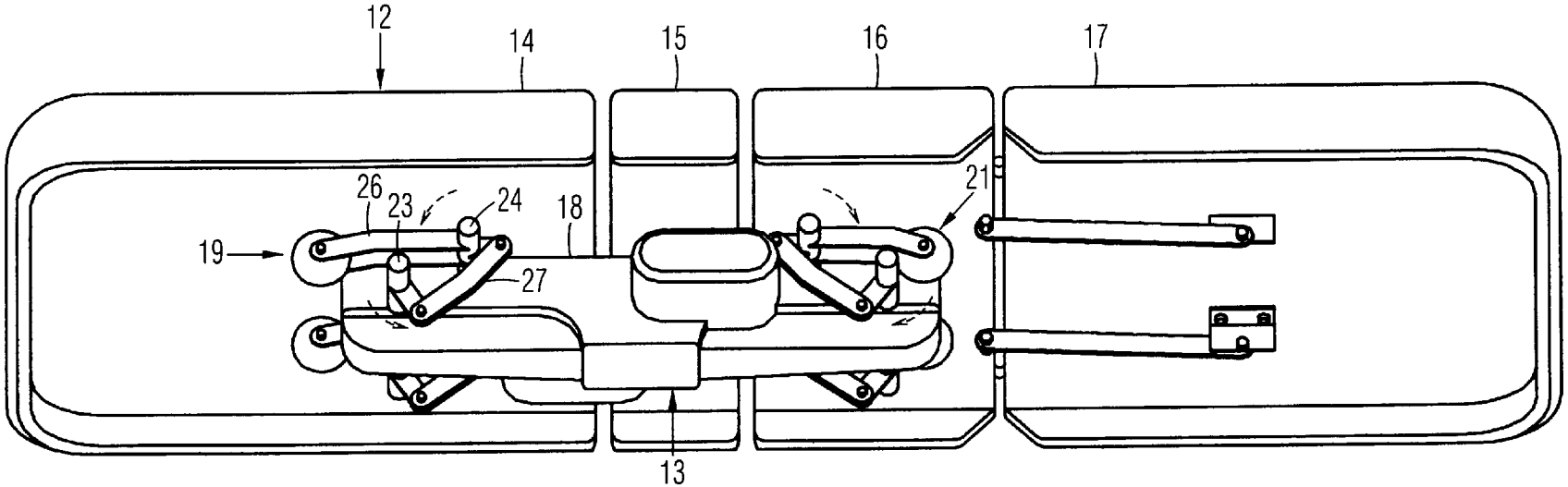
FIG. 4 is a bottom perspective broken view of the tabletop in a fully lowered position.

As shown in FIG. 3, torso section 14 is lowered by rotating powered axle 23 of each actuating linkage 19 counterclockwise. Since lifting arm 26 is linked to power axle 23 by connecting arm 27, lifting arm 26 is also rotated counterclockwise, so that its upper end is lowered, and torso section 14 is lowered. Upper leg section 16 and lower leg section 17 are lowered by operating actuating linkages 21 in the opposite direction. Tabletop 12 is shown lowered to an intermediate position in FIG. 3, and to a fully lowered position in FIG. 4 where torso section 14, seat section 15, upper leg section 16, and lower section 17 are generally coplanar.

SUMMARY AND SCOPE

Accordingly, an articulated table is provided for supporting a person. It provides articulated sections for raising the torso and legs of a person to different positions. It employs a compact actuator assembly for providing enough leg room for a massage therapist to sit next to the table. It also maintains a lower leg section in a comfortable level position throughout its range of adjustment.

Although the above description is specific, it should not be considered as a limitation on the scope of the invention, but only as an example of the preferred embodiment. Many variations are possible within the teachings of the invention. For example, the torso section may be arranged to raise and lower simultaneously with or independently of the leg sections. The drive unit may be any suitable motorized drive unit that drive the powered axles of the actuating linkages. The legs may be of any length, and may be short enough so that the table may be used as a bed. Therefore, the scope of the invention should be determined by the appended claims and their legal equivalents, not by the examples given.

I claim:

1. An articulated table, comprising:

a frame;

a tabletop supported by said frame, said tabletop including a hinged section;

a drive unit attached to said frame;

a power axle driven by said drive unit, said power axle having an axis in fixed relation with said frame;

a follower axle having an axis in fixed relation with said frame and generally parallel to said axis of said power axle;

a crank arm extending generally orthogonally from said power axle;

a lifting arm extending generally orthogonally from said follower axle, a distal end of said lifting arm engaging said hinged section of said tabletop; and a connecting arm having one end pivotally connected to said crank arm at a first position spaced from said power axle, and another end pivotally connected to said lifting arm at a second position spaced from said follower axle, said connecting arm transmitting rotation of said power axle to said follower axle, when said power axle and said crank arm are rotated in a predetermined direction, said follower axle and said lifting arm are rotated in a similar direction, said distal end of said lifting arm is raised, and said hinged section of said tabletop is raised by said lifting arm.

2. The articulated table of claim 1, wherein said tabletop is comprised of a pivotable torso section, which is pivotally connected to a fixed seat section, which is pivotally connected to a pivotable upper leg section, which is pivotally connected to a pivotable lower leg section.

3. The articulated table of claim 1, wherein said tabletop is comprised of a pivotable torso section, which is pivotally connected to a fixed seat section, which is pivotally connected to a pivotable upper leg section, which is pivotally connected to a pivotable lower leg section, and further including an idler arm pivotally connected between said lower leg section and said frame, said idler arm is generally equal in length and parallel to said upper leg section, said idler arm maintaining said lower leg section at a constant angle.

4. An articulated table, comprising:

a frame;

a tabletop supported by said frame, said tabletop including a hinged section;

a drive unit attached to said frame;

a power axle driven by said drive unit said power axle having an axis in fixed relation with said frame;

a follower axle having an axis in fixed relation with said frame and generally parallel to said axis of said power axle;

a crank arm extending generally orthogonally from said power axle;

a lifting arm with a first section and a second section extending generally orthogonally in different directions from said follower axle, a distal end of said first section engaging said hinged section of said tabletop; and a connecting arm having one end pivotally connected to said crank arm at a first position spaced from said power axle, and another end pivotally connected to said second section of said lifting arm at a second position spaced from said follower axle, said connecting arm transmitting rotation of said power axle to said follower axle, when said power axle and said crank arm are rotated in a predetermined direction, said follower axle and said lifting arm are rotated in a similar direction, said distal end of said first section of said lifting arm is raised, and said hinged section of said tabletop is raised by said lifting arm.

5. The articulated table of claim 4, wherein said tabletop is comprised of a pivotable torso section, which is pivotally connected to a fixed seat section, which is pivotally connected to a pivotable upper leg section, which is pivotally connected to a pivotable lower leg section.

6. The articulated table of claim 5, wherein said tabletop is comprised of a pivotable torso section, which is pivotally connected to a fixed seat section, which is pivotally connected to a pivotable upper leg section, which is pivotally connected to a pivotable lower leg section, and further including an idler arm pivotally connected between said lower leg section and said frame, said idler arm is generally equal in length and parallel to said upper leg section, said idler arm maintaining said lower leg section at a constant angle.

7. An articulated table, comprising:

a frame;

a tabletop supported by said frame, said tabletop including a pivotable torso section, and a pivotable upper leg section pivotally connected to a pivotable lower leg section;

an idler arm pivotally connected between said lower leg section of said tabletop and said frame, said idler arm is generally equal in length and parallel to said upper leg section; and a drive unit attached to said frame;

a first actuating linkage, and a second actuating linkage positioned under said tabletop and each comprising:

a power axle driven by said drive unit, said power axle having an axis in fixed relation with said frame;

a follower axle having an axis in fixed relation with said frame and generally parallel to said axis of said power axle;

a crank arm extending generally orthogonally from said power axle;

a lifting arm extending generally orthogonally from said follower axle; and a connecting arm having one end pivotally connected to said crank arm at a first position spaced from said power axle, and another end pivotally connected to said lifting arm at a second position spaced from said follower axle, said connecting arm transmitting rotation of said power axle to said follower axle, when said power axle and said crank arm are rotated in a predetermined direction, said follower axle and said lifting arm are rotated in a similar direction and said distal end of said lifting arm is raised;

thus said hinged torso section is raised and lowered by said lifting arm of said first actuating linkage, said hinged upper leg section is raised and lowered by said lifting arm of said second actuating linkage, and said lower leg section is raised and lowered in unison with said upper leg section, said idler arm maintaining said lower leg section at a constant angle throughout an entire range of movement of said lower leg section because said idler arm is generally equal in length and parallel to said upper leg section.

8. The articulated table of claim 7, wherein said first actuating linkage and said second actuating linkage are generally mirrored normal to a longitudinal axis of said tabletop, so that said lifting arm of said first actuating linkage and said lifting arm of said second actuating linkage rotate in opposite directions.

9. The articulated table of claim 7, further including a fixed seat section pivotally connected between said torso section and said upper leg section.

* * * * *